US005267895A

United States Patent [19]

Mitchell et al.

[11] Patent Number: 5,267,895

[45] Date of Patent: * Dec. 7, 1993

[54] AIR CIRCULATION SYSTEM

[75] Inventors: George E. Mitchell, Rosemont; Michael H. Pelosi, III, Downingtown, both of Pa.

[73] Assignee: CenterCore, Inc., Wayne, Pa.

[ * ] Notice: The portion of the term of this patent subsequent to Nov. 19, 2008 has been disclaimed.

[21] Appl. No.: 920,251

[22] Filed: Jul. 27, 1992

Related U.S. Application Data

[63] Continuation of Ser. No. 710,799, Jun. 5, 1991, Pat. No. 5,180,332, which is a continuation-in-part of Ser. No. 536,179, Jun. 11, 1990, Pat. No. 5,065,668.

[51] Int. Cl.[5] ..... F24F 7/007; F24F 13/06

[52] U.S. Cl. ..... 454/57; 454/62

[58] Field of Search ..... 454/230, 57, 62, 235, 454/236, 231, 234, 188, 241

[56] References Cited

U.S. PATENT DOCUMENTS 3,724,172 4/1973 Wood ..... 55/97
4,616,557 10/1986 Paoluccio ..... 454/230
4,872,397 10/1989 Demeter et al. ..... 454/235
5,065,668 11/1991 Mitchell et al. ..... 454/57
5,074,116 12/1991 Kadotani et al. ..... 454/236

*Primary Examiner*—Albert J. Makey
*Assistant Examiner*—William C. Doerrler
*Attorney, Agent, or Firm*—Eugene E. Renz, Jr.

[57] ABSTRACT

An apparatus for use with a multi-station workspace including a predetermined number of core walls which define an enclosed core. The core walls include an inlet at or below a predetermined height. The apparatus includes a platform positioned in the core at a location above the predetermined height substantially separating the core into a lower air intake chamber and an upper air discharge chamber. The platform further includes a filter in the lower chamber and a blowers drawing air from the intake chamber through the filter to the upper chamber. Finally, a core lid is positioned at the top of the core and includes air discharge vents. The discharge vents are side vents proximate each of the core walls for discharging air in a substantially horizontal direction out from each of the core walls to form an envelope of clean, filtered air for the workspace.

12 Claims, 4 Drawing Sheets

AIR CIRCULATION SYSTEM

This is a continuation of copending application Ser. No. 07/710,799 filed on Jun. 5, 1991 now U.S. Pat. No. 5,180,332 which is a continuation-in-part of the then copending application Ser. No. 07/536,179 filed on Jun. 11, 1990. Nov. 19, 1991.

FIELD OF THE INVENTION

The invention relates to an improved air circulation system for workspace units, and particularly to workspace units which stand alone and which have a plurality of work stations centered about a center column or core.

BACKGROUND OF THE INVENTION

U.S. Pat. No. 4,625,633, in the name of Martin, is a commonly owned patent which describes a ventilated core unit for service connections. Various prior art patents are disclosed in the Martin patent. The disclosure of all of those prior art patents may be summarized by the statement in the Martin patent that none of the prior art disclose the benefits of an independently controllable zone unit that is not attached to the building HVAC equipment by air ducts.

Martin correctly identifies a modern trend in office furniture and layout arrangements, in which small, semiprivate working cubicles are created about a central core with multiple work stations and equipment emitting from that core. The Martin design has been very successful in providing a central core unit which accomplishes both ventilating and utility connections for peripheral work spaces.

The principal basis upon which the Martin invention is founded is the use of a central core unit for local ventilating and also for providing utility connections to peripheral work spaces around the core. The work spaces each are provided with electrical terminal devices and air inputs A work space fan is mounted in a side wall of the cabinet. That fan is operable under user control to draw air from the work space into the plenum defined by the walls of the cabinet. The air is then discharged to the common area directly above the workspace.

No system is perfect, however, and several drawbacks have been encountered in the use of the Martin system. Specifically, the system is both assisted by and encumbered by the fact that it has a central column 30 which functions as a service conduit. This central core conduit makes it easy to supply power to the system. It also makes it significantly more difficult to remove the top 24 of the core for access to the internal mechanisms. In addition, mounting a filter 84 and fan 80 on the top 24 causes an imbalance unless the filter is centered. Of course, when a center conduit 30 is present, that cannot be accomplished. Alternatively, a plurality of fans 80 are required. In either case, difficulty in cleaning the filter 84 is significant because the center conduit is directly connected to top 24 of core unit 20.

Yet another difficulty which is experienced in prior art systems is that each core wall of core unit includes it own inlet fan which is adjustably controlled by the worker at each specific work station. This fan, however, does not directly control the exhaust air. A worker must be present in order to control the use of the specific intake fan for each wall of the core. In addition, of course, the requirement of a separate fan for each core wall increases expense and complicates the assembly and maintenance of the system.

Even though the Martin system is successful and provides many advantages to the users, that system is not capable of providing a complete, controlled environment which would be ideal under present day standards. Specifically, what is needed is a more efficient and effective way to transfer or treat the air within the region of all of the work stations about a central core workplace.

Ideally, the environment directly centered about the core of the stand alone work space should have the best possible environment. Particularly, bacteria and smoke should be eliminated and the individual work stations should each function in the nature of a cleanroom.

In addition, the device should be simple and easy to maintain. Access to the interior of the column for maintenance of other equipment should be facilitated and should not be prevented by the design of the air flow system. Greatly improved efficiencies and the ability to provide virtually an envelope of clean air are objects of the present invention and are not found in the prior art.

SUMMARY OF THE INVENTION

It has now been discovered that these and objects of the present invention are accomplished in the following manner. Specifically, an apparatus for use with multistation work spaces has been discovered The device includes a predetermined number of core walls which define an enclosed core. Each of the core walls include an inlet vent at or below a predetermined height.

Positioned within the core at a location above the predetermined height is a platform means. The platform substantially separates the core into a lower air intake chamber and an upper air discharge chamber. The platform further includes filter means in the lower chamber. The filter may include prefilter means which filter odor and/or large particles. Also included are air transfer means for drawing air from the intake chamber through the filter to the upper chamber.

In addition, the apparatus of the present invention includes core lid means, which is positioned at the top of the core defined by the core walls, to complete the enclosure of the air discharge chamber. The core lid includes air discharge means in the form of side vent means proximate each of the core walls for discharging air in a substantially horizontal direction out from each of the core walls to form an envelope of air with the inlet.

Typically, the predetermined height is positioned sufficiently above a normal work surface so that the vent means is positionable above the normal work surface of a work station. The platform is mounted in a position abutting all of the core walls to substantially prevent air flow between the intake chamber and the discharge chamber except through the filter means. Specific filters are preferably those filters known as HEPA filters, which have a minimum efficiency of 99.97% of particles measured at 0.3 microns.

The core lid is assembled to direct air out horizontally through side vent means which may or may not include baffles to further direct the air in a horizontal direction. Because the side vent means is exhausting a significant volume of air horizontally and above the seated worker, and because all of the air in the system is drawn in to the vent means in the core walls, a person seated at the work station is surrounded or encapsulated by an envelope of air from which most of the particles 0.3 microns and larger have been removed. This envelope of air is effective as a cleanroom.

In its preferred form, the apparatus of the present invention includes a single motor and blower mounted in the upper chamber. The blower has sufficient capacity to provide up to about 30 air changes per hour for the region included in a thirteen foot circle having its axis at the center of the core. This motor has a capacity rating of at least 300 cubic feet per minute. Other sizes and capacities are also useful.

Finally, it is also contemplated that the preferred embodiment of the present invention will include a prefilter means on the filter, which prefilter is suitable for removing odors and/or larger particulate from air passing through the filter means. Activated charcoal and polyester filters may be used for these functions.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
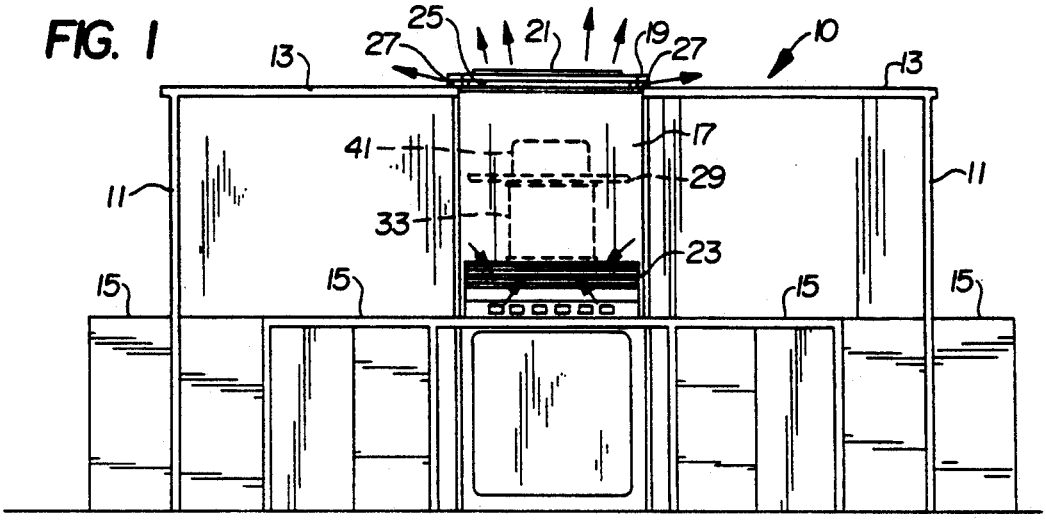
FIG. 1 is a side elevational view of the device of this invention in place in a multiple work unit.

A workstation, shown generally by the reference numeral 10 includes a plurality of radially extending side walls 11 which have top caps 13. Defining the particular workplaces are desk work surfaces 15 which allow for individual work spaces, shown generally in the figures. It should be noted that a variety of custom designed work spaces are available for various purposes such as accounting, word processing, general office work, light assembly, and other functions.

Figure 2:
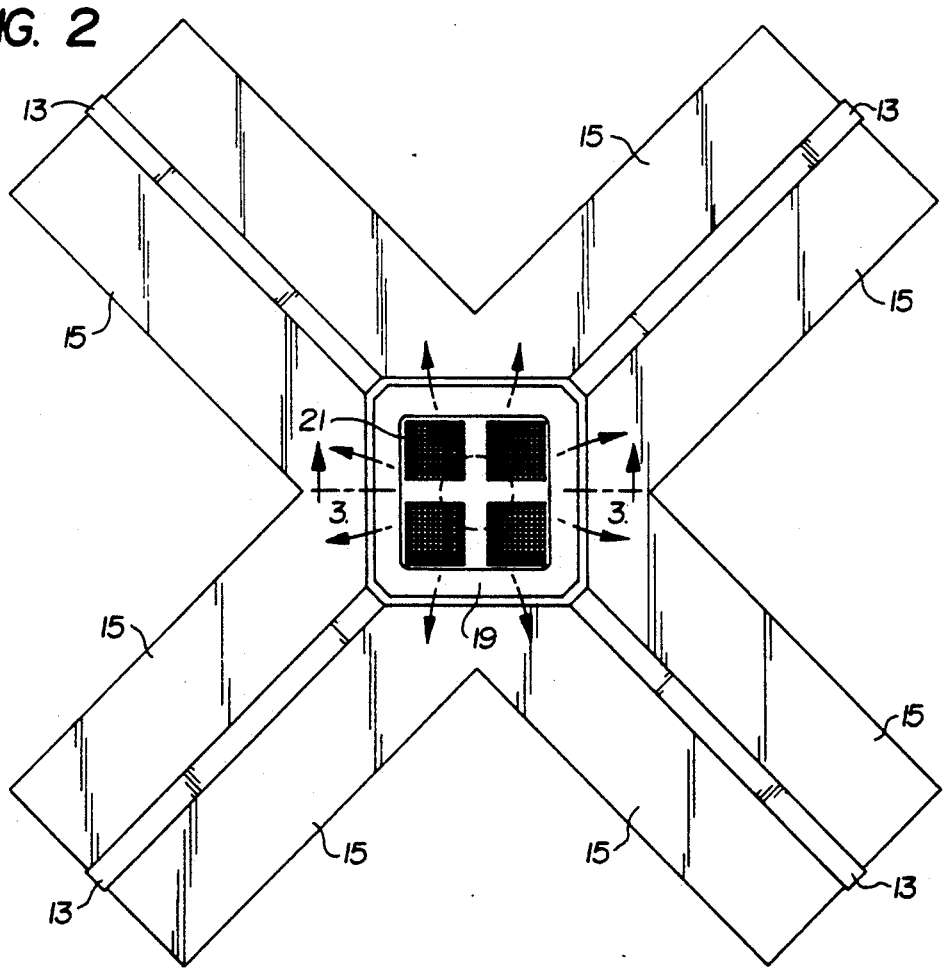
FIG. 2 is a plan view of the multiple work station shown in FIG. 1.

Each of the side walls 11 radiate from the ends of core walls 17 which together define a center core about which the work stations are centered. While a four sided core is shown in FIG. 2, it is to be appreciated that the number of core walls 17 can be varied from three or less to as many as eight or more sides. Each station is designed for the specific purposes of the consumer and the number of work spaces does not materially affect the present invention.

At the top of the column defined by the core walls 17 is a core lid 19 or 20. Contained within the core defined by the core wall 17 and the core lid 19 or 20 are, in addition to the present invention, other equipment. For example, electrical controls and electrical power is often directed to the central core area and access to that power or electrical equipment is through the core walls 17. Depending upon the needs of the work station, water, air or other gases, and the like can be provided from the central core defined by the core walls 17. Also, various forms of communication devices can be routed through that central core area.

In one embodiment, the air flow system of the present invention includes a top air grate 21 which is preferably formed in an egg crate design. For example, low cost polystyrene egg crate louvers are effective for use as the top air grates 21. More preferred is a solid core lid 20, shown in FIG. 8 and FIG. 9.

Air is taken into the central core area behind the core walls 17 through an intake vent 23. As will be described hereinafter, air is processed in the interior portion behind the walls 17 and is exhausted or expelled out of the core area through gaps 25 between the core wall 17 and the core lid 20. Gaps 25 are formed by spacers 27 which provide an elevation of the core lid 20 so that air is directed horizontally out over the top of the person in the work space.

Figure 3:
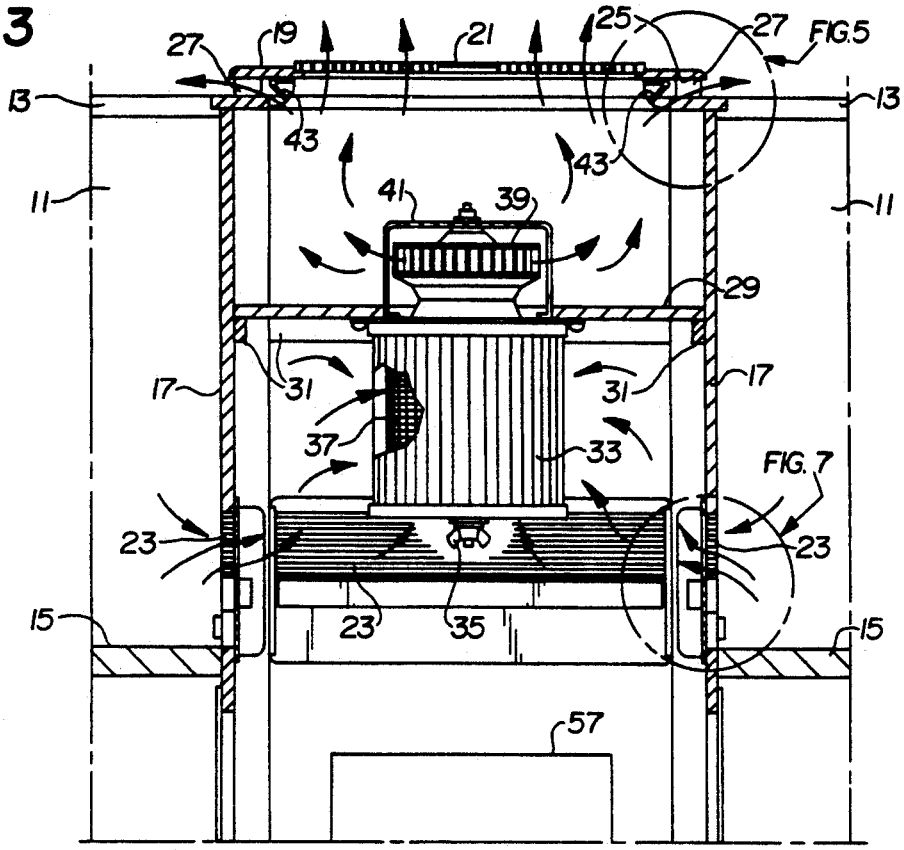
FIG. 3 is an enlarged section view taken along lines 3—3 of FIG. 2.
Figure 4:
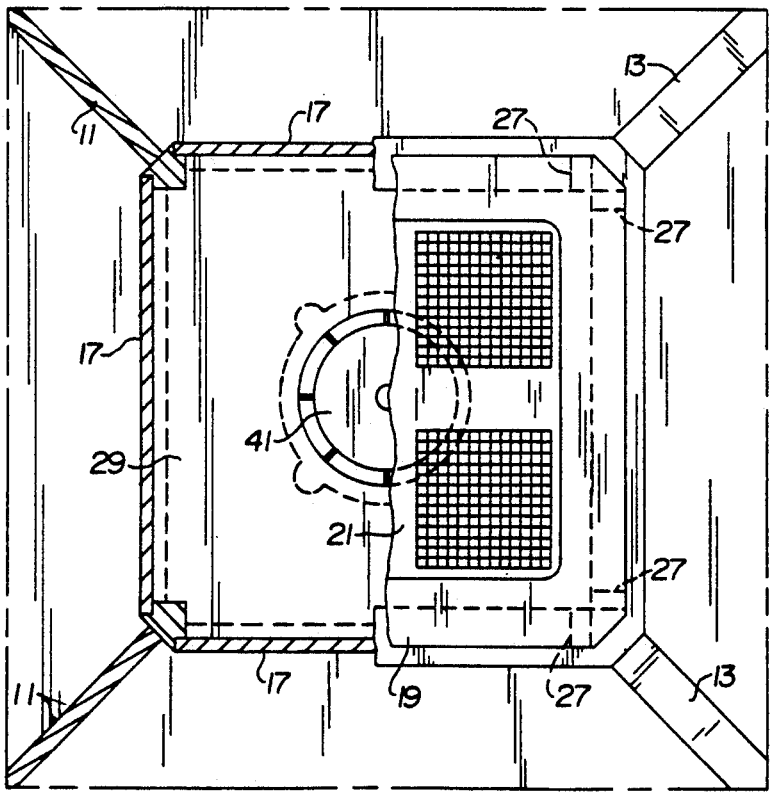
FIG. 4 is a plan view, partially cut away and partially in section, of the center portion of the device of FIG. 3.

As is easily seen in FIG. 3, the region defined by the core walls 17 is divided into an upper chamber and a lower chamber by a motor platform 29. Platform 29 is mounted to the sidewalls by support brackets 31 and can be lifted out of the central core as needed. Mounted on the lower portion of motor platform 29, in the lower chamber, is a filter 33, shown as being held by wing nut 35. Filter 33 is an exterior filter, such as would be useful for removing particulate and odor. The outer filter 33 is intended to filter large particles and will trap odor when activated charcoal and/or other odor absorbing materials are employed. Inside the filter 33 is a canister or other type air filter 37 which is known generally as a HEPA filter. These HEPA filters 37 are commercially available and have an efficiency of at least 99.97% at 0.3 microns, using a DOP test procedure.

As is noted, the motor platform 29 is positioned by brackets 31 at a point in the interior between walls 17 where the lower chamber is defined. This lower chamber receives air through intake vents 23 which, as shown in FIG. 3, are positioned above the desk work space 15. Typically, smoke from ashtrays would be drawn in through the intake vent 23 as is all of the ambient air adjacent the worker in the work space. Vents 23 are the only source of air for the apparatus of the present invention.

Motor platform 29 also supports the motor 39 and its motor bracket 41 in a chamber above platform 29. The chamber is enclosed by the platform 29, the core walls 17 and the core lid 19. This motor 39 is the sole source of air movement. Filtered, clean and deodorized air is produced through as it passes filters 33 and 37 and is exhausted by motor 39 into the upper chamber above the platform 29.

Some of the air in the upper chamber flows through the top grates 21 in a vertical direction while another major quantity of the air flows horizontally out through the gaps 25 defined by spacers 27. Air flowing through gaps 25 flows horizontally away from the core wall 17. The air leaving the vent or gap 25 flows over the work station and is pulled down as the air is drawn into the core through vent 23. This causes the formation of an air envelope which functions similar in nature to that of a cleanroom. In a preferred embodiment, the motor 39 is capable of moving at least 300 cubic feet per minute of air. When the device is operating at full capacity, it is possible to accomplish over 30 air changes per hour within a thirteen foot circle having its diameter at the center of the core.

It is recognized that not every worker requires or desires the same degree of air quality. Under some circumstances, it may be desirable to vary the amount of air which is forced by motor 39 up through the grates 21 in proportion to the amount of air exited through the gap 25 between the lid 19 and the wall 17.

Figure 5:
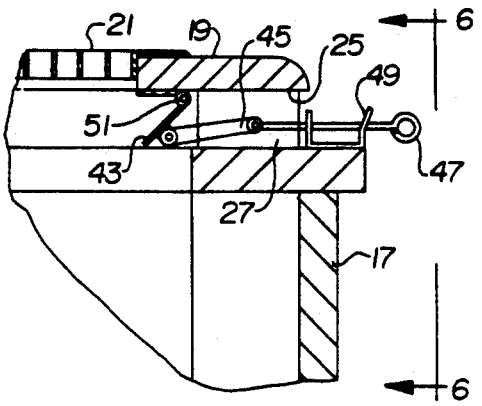
FIG. 5 is a greatly enlarged view of the portion in the circle shown in FIG. 3 and designated FIG. 5.
Figure 6:
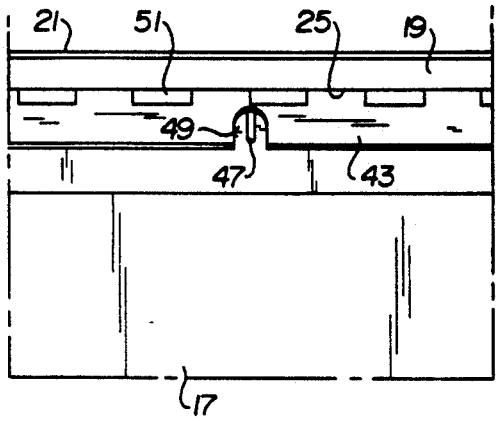
FIG. 6 is a sectional view taken along the lines 6—6 of FIG. 5.
Figure 7:
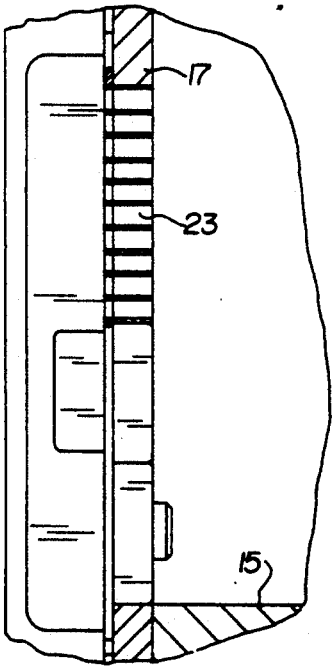
FIG. 7 is an enlarged view of the circle shown in FIG. 3 and designated FIG. 7.
Figure 8:
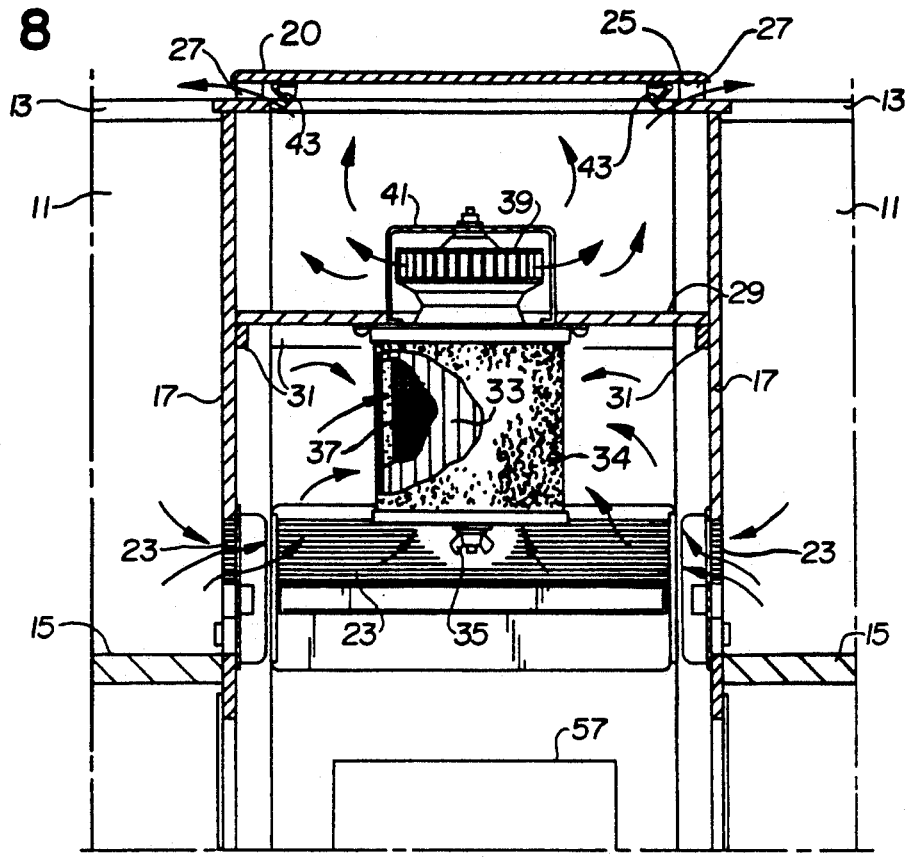
FIG. 8 is an enlarged view similar to FIG. 3, showing an alternative, preferred embodiment.

An alternative embodiment shown in greater detail in FIG. 5 provides a baffle 43 which, in the extended position shown in FIG. 5, helps to direct air against the under surface of the lid 19 of FIG. 3 or lid 20 of FIG. 8 and out through gap 25 in a horizontal direction out over each of the work stations. Baffle 43 is connected via linkage 45 to a pull handle 47. C clamp 49 holds the handle 47 in whatever location is desired. Squeezing the two ends of C clamp 49 releases pressure on handle 47 and the location of baffle 43 can be changed, via linkage 45. If desirable, of course, the baffle can be pulled to a position which closes the gap 25 and no air is forced horizontally over that particular work station. Alternatively, a gap can be maximized as shown in FIG. 5. Of course, intermediate positions are also easily obtainable. Hinge 51 allows baffle 43 to move from one extreme to the other of its positions simply by adjusting the pull handle 47 and C clamp 49.

In the preferred embodiment shown in FIG. 8, the region defined by the core walls 17 is again divided into an upper chamber and a lower chamber by a motor platform 29. Platform 29 is mounted to the sidewalls by support brackets 31. Mounted on the lower portion of motor platform 29, in the lower chamber, is a filter assembly shown as being held by wing nut 35. Filter 34 is an exterior filter, such as would be useful for removing particulate and may be made from polyester or other synthetic filter materials. Filter 34 is intended to filter large particles. Inside filter 34 is another outer filter 33 which will trap odor when activated charcoal and/or other odor absorbing materials are employed. Inside the filter 33 is a canister or other type air filter 37, known generally as a HEPA filter. These HEPA filters 37 are commercially available and have an efficiency of at least 99.97% at 0.3 microns, using a DOP test procedure.

As has been noted, the lower chamber receives air through intake vents 23 which, as also shown in FIG. 8, are positioned above the desk work space 15. All of the ambient air adjacent the worker in the work space enter vent 23. Vents 23 are the only source of air for the apparatus of the present invention.

Motor platform 29 also supports the motor 39 and its motor brackets 41 in a chamber above platform 29. The chamber is enclosed by the platform 29, the core walls 17 and the core lid 20. This motor 39 is the sole source of air movement. Filtered, clean and deodorized air is produced through as it passes filers 34, 33 and 37 and is exhausted by motor 39 into the upper chamber above the platform 29.

Air is discharged in a common plane which is generally horizontal so that substantially all of the air flows horizontally out through the gaps 25 between wall 17 and lid 20, defined by spacers 27. Air flowing through gaps 25 flows horizontally in a common plane away from the core wall 17. The air leaving the vent or gap 25 flows over the work station and is pulled down as air is drawn into the core through bent 23. This causes the formation of an air envelope which functions similar in nature to that of a cleanroom.

Figure 9:
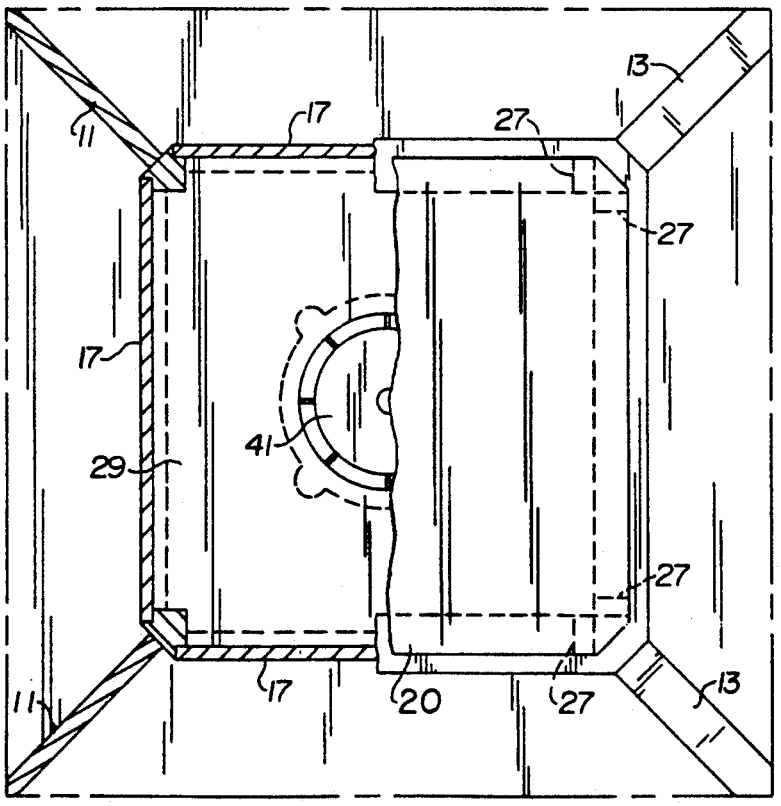
FIG. 9 is a plan view, partially cut away and partially in section, of the center portion of the device of FIG. 8.

FIG. 9 shows solid core lid 20, whereas the arrows in FIG. 8 shows air flow in a common plane leaving the core after being pulled through inlet 23, particle filter 34, odor filer 33 and HEPA filter 37. Outside the core, the envelope of air is clean filtered air.

The present invention addresses the concept of providing individual envelopes of clean, filtered air at each station to remove problems causing particles. Tests were made to determine the efficacy of the present invention. Specifically, particulate matter was measured at an office for specific regions, using the system shown in the drawings. These results were compared with space where only HVAC systems were run. Particle count in all of these tests is measured as number of particles of 0.5 microns or larger per cubic foot of air. Presented below in TEST SERIES ONE are the results of some tests which show the achievement of surprising and superior results.

TEST SERIES 1

| Room Condition | Date | Time | Particle Count |
|---|---|---|---|
| HAC only | 11/29/90 | 2:10 p.m. | 354,930 |
| HVAC only | 11/29/90 | 2:40 p.m. | 417,150 |
| HVAC only | 11/29/90 | 3:40 p.m. | 407,030 |
| Present Invention: Low Speed | 11/30/90 | 2:00 p.m. | 230,109 |
| Present Invention: High Speed | 11/30/90 | 3:00 p.m. | 63,470 |
| Present Invention: High Speed | 11/30/90 | 3:15 p.m. | 40,008 |
| Present Invention: High Speed | 11/30/90 | 3:30 p.m. | 27,777 |

As can be seen, more than an order of magnitude of improvement was achieved by the use of the present invention. Adjacent rooms had counts on Nov. 29, 1990 and Nov. 30, 1990 of 464,110 and 418,420 for the first room and 614,120 and 220,680 for the second room. Remarkedly, the present invention was able to achieve a particle count under 100,000 for an office.

Similar tests were made in several offices in a hospital. Again the comparison is between ordinary HVAC and the present invention for particle count as defined above.

TEST SERIES II

| Room/System | Date | Particle Count |
|---|---|---|
| Hospital Hall/HVAC | 12/07/90 | 367,220 |
| Hospital Hall/HVAC | 12/12/90 | 707,590 |
| Library/HVAC | 12/07/90 | 126,350 |
| Library/HVAC | 12/12/90 | 640,610 |
| Office/Present Invention | 12/07/90 | 29,580 |
| Office/Present Invention | 12/12/90 | 31,390 |
| Financial Area/Present Invention | 12/07/90 | 33,500 |
| Financial Area/Present Invention | 12/12/90 | 41,350 |

As can be seen from the data above, particle count for both the office and financial area were remarkedly reduced, again below 100,000 particles per cubic foot of air. The importance of reducing particle count, whatever their level is seen in the correlation between particle count and "Sick Building Syndrome" where high sickness and/or absenteeism is caused by high particle count.

Programming the rate of air movement can provide a substantial increase in air quality. Accordingly, the present invention apparatus would be programed to operate at a rapid rate of at least 300 cubic feet per minute and would thereby accomplish at least 30 air changes per hour in the thirteen foot circle encompassing the present invention. As the employees report for work, the rate of air change can be decreased to maintain a steady state of clean air so that 10 to 30 complete air changes per hour are accomplished.

Under appropriate conditions, it has been shown to be possible to obtain a class 100,000 reading for an office, which is highly desirable for health reasons as well as insurance ratings. Properly operated, the present system reduces bacteria and cuts total particle count by a significant factor.

Another important factor is that each workspace becomes its own protected envelope of clean filtered air. In effect, the core and filters form a source of air which reaches out over the core centered workspaces like an umbrella of protection. The air flowing in the common plane forms the top of the umbrella, and as velocity is lost, becomes pulled down, enveloping the workplace, being drawn into vents 23. A suitable blend of fresh and filtered air is achieved.

The system is easily accessible for repair or reconditioning. Simple removal of the access panel 57 allows access to both filters. The prefilters 33 and 34 may be changed two or three times a year as part of routine maintenance. These prefilters extend the life of a HEPA filter which is recommended to be changed every two years. Of course, simply loosening wing nut 35 allows for quick removal of the HEPA filter 37 as well as for cleaning or replacement.

While various modifications and embodiments have been shown, it is recognized that a variety of embodiments are possible without departing from the spirit of the present invention. Having thus described the invention,

What is claimed is:

1. A work station array including at least one workspace defined in part by side walls, comprising:

an enclosed core associated with said work station array and including air inlet means for drawing air into said core at or below a predetermined height and having means for circulation of said air through said core; and air discharge means at the upper end of said core for discharging said air in a predetermined controlled direction and at a distance above said height to cooperatively form an envelope of air surrounding a space defined (i) in part by said side walls and said core wall, and (ii) in part by air flow out of said air discharge means and into said air inlet means, whereby an individual in said workspace is enclosed in circulated air.

2. A method for providing a circulated air workspace for individuals, comprising the steps of:

forming a work station core and providing side walls extending form said core to define in part at least one work station, said core having an air inlet at or below a predetermined height;

circulating air through said core; and discharging said air from said core from air discharge means above said height and proximate the top of said core to provide an envelope of air circulated from said air discharge means out over said workspace and into said air inlet to further define in part said work station.

3. A work station including at least one work space, comprising:

an enclosed core having an upper and a lower end and being associated with said work station and including air inlet means for drawing air into said core at one end; and air discharge means on the other end of said core for discharging air in a predetermined plane out from said core to cooperatively form an envelope of air surrounding a space defined (i) in part by said core, and (ii) in part by air flow out of said air discharge means and into said air inlet means to enclose an individual in said work station in a envelope of air without directing air directly on said individual.

4. The work station of claim 3 wherein said air is discharged to provide approximately thirty air changes per hour for the region included by a thirteen foot circle having its axis at the center of said core.

5. The work station as claimed in 4 including air filter means for filtering the air circulated forming said envelope of air.

6. The work station as claimed in claim 5 wherein said filter means includes a HEPA filter.

7. The work station as claimed in claim 4 wherein said air circulating means includes a blower.

8. The work station as claimed in claim 7 wherein said blower has at least a 300 cubic feet per minute rating.

9. The work station as claimed in claim 7 wherein said blower is the sole air moving means causing air to circulate in said enclosed space.

10. The work station as claimed in claim 5 wherein said filter means includes a prefilter for removing odors from the air passing through said filter means.

11. The work station as claimed in claim 5 wherein said filter means includes prefilter means for removing larger particulate from the air passing through said filter means.

12. The work station as claimed in claim 3 wherein said air is discharge with a blower having at least a 300 cubic feet per minute rating.

* * * * *